United States Patent [19]

Takacs

[11] Patent Number: 5,046,623

[45] Date of Patent: Sep. 10, 1991

[54] BRUSH RACK

[76] Inventor: Donald Takacs, 1527 Warmsville Center Rd., So. Euclid, Ohio 44121

[21] Appl. No.: 550,315

[22] Filed: Jul. 9, 1990

[51] Int. Cl.[5] ..... A47F 7/00

[52] U.S. Cl. ..... 211/65; 248/113

[58] Field of Search ..... 211/65, 66; 248/110, 248/113

[56] References Cited

U.S. PATENT DOCUMENTS

| | | | |
|---|---|---|---|
| 571,438 | 11/1896 | Harlow | 248/113 X |
| 2,278,650 | 4/1942 | Drinkwater | 211/65 |
| 2,533,355 | 12/1950 | Comfort | 211/65 |
| 2,566,650 | 9/1951 | Anderson | 211/65 |
| 2,744,635 | 5/1956 | Hiss | 248/113 X |
| 2,907,540 | 10/1959 | Wheeler | 248/113 |
| 3,156,364 | 11/1964 | Wolcott | 248/110 X |
| 4,852,833 | 8/1989 | Lockwood | 248/110 |

*Primary Examiner*—Robert W. Gibson, Jr.

[57] ABSTRACT

A holder for paintbrushes and the like in a container having an appropriate cleaning fluid is disclosed. The holder has a circular support ring with at least one transverse rod affixed at its ends to the inner periphery of the support ring. Gripping means such as clips for holding the brushes are affixed along the length of the transverse rod. The circular ring is sized to engage the inner surface of the container.

1 Claim, 1 Drawing Sheet

BRUSH RACK

TECHNICAL FIELD

The present invention relates to a paint brush holder used in association with a paint pail used for soaking and cleaning different paint brushes in a paint solvent.

SUMMARY OF THE INVENTION

The present invention can be used for hanging the paint brushes to dry. The paint brushes are held so the bristles don't bend, break, or get injured by being suspended off the bottom of the paint pail. The paint brush holder can be transferred from paint container to another. The shape of the device permits it to fit snuggly into the taper of the paint pail. A plurality of brushes of various sizes can be held at once. It can be set over the top of a smaller bucket for cleaning only one or two paint brushes. A number of various lengthes of brush handles can be held by sliding the brush handles up or down to various depths for cleaning or soaking in the paint solvent.

The brush holder has a circular ring for support against the inner tapered walls of the paint pail with a transverse rod connecting one side to the other across its diameter. Affixed across the transverse rod are a series of clips to which the paint brushes are clipped and suspended into the paint solvent.

The clips may be parallel or staggered from one another for easy attachment to the transverse rod.

The device can be made of metal strips, wire, or plastic.

DETAILED DESCRIPTION OF DRAWING

Figure 1:
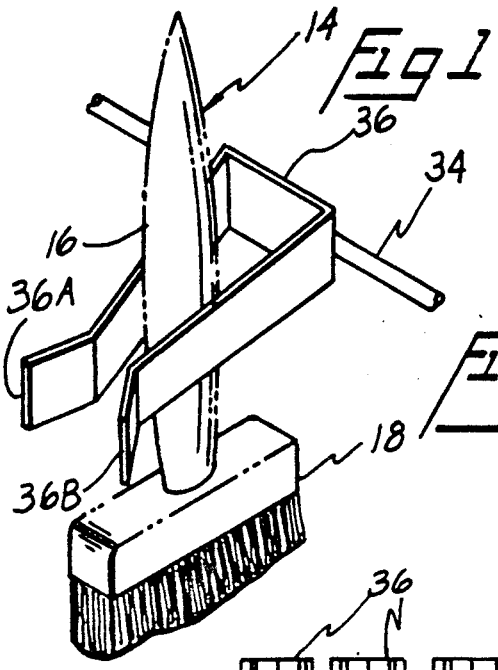
FIG. 1 is an exploded view of brush holder with brushes suspended in a paint container.

Refering to the drawing of FIG. 1, which shows the paint pail 10 having tapered sides found in prior art for holding a paint solvent 12 for which the brushes 14 found in prior art are soaking in. The handle 16 of end brush 14 is being held upright and suspended and can be adjusted to any height up or down for soaking the bristles 18 of the brush 14. The brush holder 30 which has a circular support ring 32 fits snuggly into the taper of paint pail 10 at the height between the top and bottom of the paint pail 10. Affixed to the circular support ring 32 is at least one transverse rod 34. If the brush holder 30 is fabricated of metal, welding or brazing would be appropiate to affix circular support ring 32 to transverse rod 34. If the brush holder 30 is fabricated out of plastic, the circular support ring 32, transverse rod 34, and the clips 36 would preferably be molded integrally. Affixed to at least one transverse rod 34 is a series of clips 36 found in prior art for a means of gripping the brush handel 16. If the clips 36 are made of metal, welding or brazing would be appropriate to affix them to transverse rod 34 or molded integrally out of plastic. These clips may be parrallel or staggered and spaced for ease of attachment to transverse rod 34.

Figure 2:
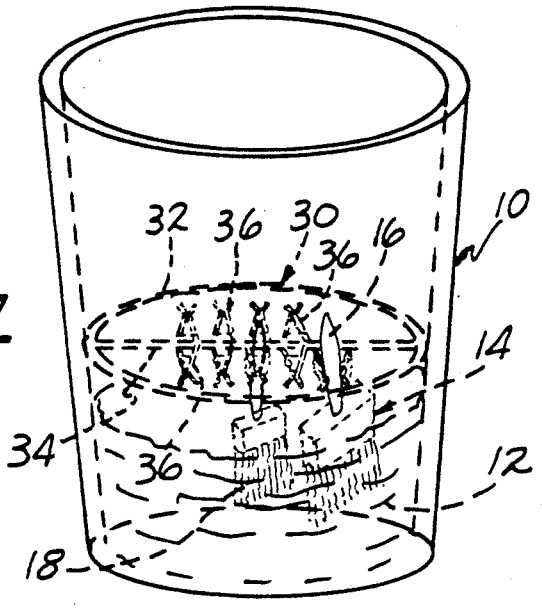
FIG. 2 is a brush held upright by a clip.

Referring to the drawing of FIG. 2, which shows the paint brush 14, paint brush handle 16, and paint bristles 18. The paint brush handle 16 is held between a clip 36 used by a means of gripping, shown in prior art. The clip 36 used for gripping, has a right hand tab 36A and a left hand tab 36B used seperating the clip when the brush handle 16 is slipped between. Clip 36 is affixed to transverse rod 34.

Figure 3:
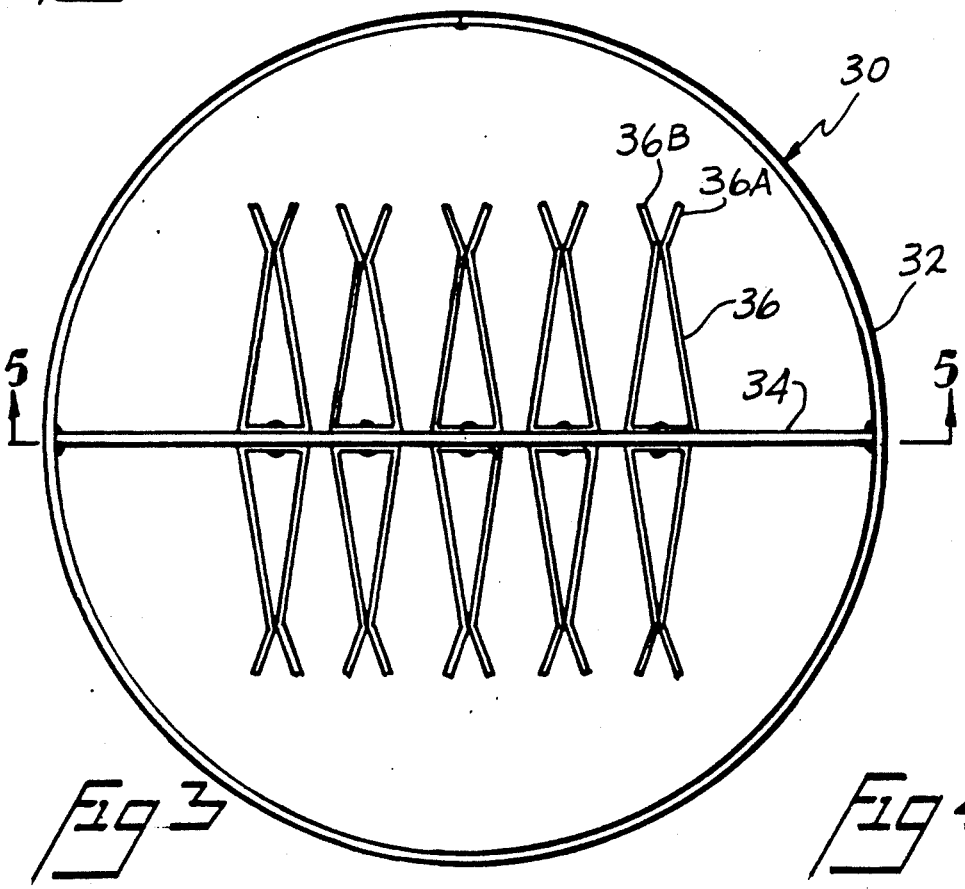
FIG. 3 is a top view of the brush holder.

Referring to the drawing of FIG. 3, which shows the paint brush holder 30 which has a circular support ring 32 that is sized to fit snuggly into the tapper of the inner surface of the paint pail 10. Affixed to the circular support ring 32 is a transverse rod 34 with a cross section line 5—5. Across the transverse rod 43 is a series of clips 36 found in prior art, and having spread flared ends 36A and 36B used for a means of gripping brush handle 16.

Figure 4:
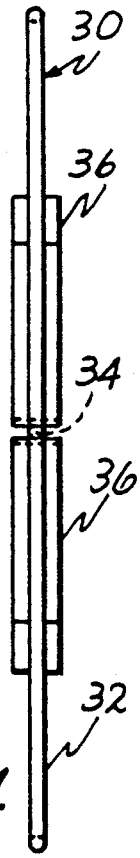
FIG. 4 is a side view of the brush holder.

Referring to the drawing of FIG. 4 wich shows the side view of the brush holder 30 looking through the side of circular support ring 32 and the end of transverse rod 34. The clips 36 are affixed to transverse rod 34.

Figure 5:
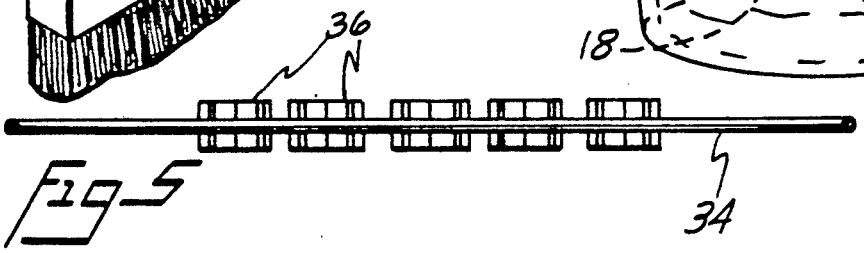
FIG. 5 is an end view of the brush holder.

Referring to the drawing of FIG. 5 which shows the transverse rod 34 with a series of clips 36 affixed to it.

I claim:

1. A brush holder for supporting at least one brush having a handle portion and a bristle portion in a container part partially filled with an appropiate cleaning fluid, said brush holder comprising:

a circular support ring sized to engage the inner surface of said container at a height between the bottom and top of said container;

at least one transverse rod having it's respective ends affixed to said circular support ring;

and at least one means for gripping said handle portion of said brush, said means for gripping affixed to said transverse rod along its intermediate portion.

* * * * *